US009407022B1

(12) United States Patent
Wang

(10) Patent No.: US 9,407,022 B1
(45) Date of Patent: Aug. 2, 2016

(54) UNITARY INTERFACE USED FOR PCI-E SAS

(71) Applicant: Amphenol East Asia Electronic Technology (Shen Zhen) Co., Ltd., Shenzhen (CN)

(72) Inventor: Xiang Wang, Shenzhen (CN)

(73) Assignee: Amphenol East Asia Electronic Technology (Shen Zhen) Co., Ltd., Shenzhen (CN)

( * ) Notice: Subject to any disclaimer, the term of this patent is extended or adjusted under 35 U.S.C. 154(b) by 0 days.

(21) Appl. No.: 14/826,837

(22) Filed: Aug. 14, 2015

(51) Int. Cl.
*H01R 12/72* (2011.01)

(52) U.S. Cl.
CPC ..... *H01R 12/721* (2013.01)

(58) Field of Classification Search
USPC ..... 439/629, 660, 637, 638, 67, 65, 160; 710/307, 306, 315; 361/737, 679.4
See application file for complete search history.

(56) References Cited

U.S. PATENT DOCUMENTS 5,171,154 A * 12/1992 Casciotti ..... H01R 12/7082 439/260
6,240,229 B1 * 5/2001 Roth ..... G02B 6/3825 385/53
7,264,512 B2 * 9/2007 Wolford ..... H01R 12/721 439/636
7,444,452 B2 * 10/2008 Chen ..... G06F 13/423 710/104
7,567,434 B1 * 7/2009 Sivertsen ..... G06F 1/18 361/679.32
7,627,709 B2 * 12/2009 Bacom ..... G06F 1/266 710/315
7,676,707 B2 * 3/2010 He ..... G06F 11/221 714/714
7,785,140 B2 * 8/2010 Henry ..... H01R 13/514 439/541.5
8,011,966 B1 * 9/2011 Tang ..... H01R 13/6461 439/638
8,031,465 B2 * 10/2011 Chen ..... G06F 1/184 361/679.46
8,174,835 B2 * 5/2012 Kim ..... G06F 1/185 361/679.31
8,199,511 B2 * 6/2012 Kim ..... H05K 7/1461 312/223.1
8,200,861 B2 * 6/2012 Davis ..... G06F 1/187 361/748
8,342,886 B2 * 1/2013 Zhang ..... H01R 12/7005 439/660
8,423,695 B2 * 4/2013 Purwin ..... H05K 1/117 361/785
8,446,738 B2 * 5/2013 Colbert ..... H05K 1/144 174/250
8,601,196 B2 * 12/2013 Sun ..... G06F 13/409 710/104
8,694,709 B2 * 4/2014 Loffink ..... H01R 13/70 361/679.33
8,702,451 B2 * 4/2014 Luo ..... H01R 12/725 439/607.28
8,858,243 B2 * 10/2014 Luo ..... H01R 13/652 439/108

(Continued)

*Primary Examiner* — Alexander Gilman
(74) *Attorney, Agent, or Firm* — Maier & Maier, PLLC

(57) ABSTRACT

The present application relates to the field of interface technology, particularly to a unitary interface used for PCI-E SAS. The unitary interface comprises a connecting assembly, a terminal assembly and a fastening assembly, the connecting assembly includes a male sub-assembly, a female sub-assembly and a PCB sub-assembly. The fastening assembly includes two ferrule-arm-hook components. Each of the two ferrule-arm-hook components includes a ferrule, an arm and a hook, with the ferrule and the hook being respectively located at one of the two ends of the arm. The male protrusion and the female protrusion at the same side, which are brought closely to each other, can be encircled tightly by one of the two ferrules, while each of the arms provides elastic force to make each of the two hooks respectively snap to one of the two sides of the female sub-assembly.

5 Claims, 2 Drawing Sheets

(56) References Cited

U.S. PATENT DOCUMENTS

| | | | | |
|---|---|---|---|---|
| 8,979,562 | B2 * | 3/2015 | Crighton | H01R 24/20 438/66 |
| 9,077,118 | B2 * | 7/2015 | Szu | H01R 24/00 |
| 9,104,385 | B2 * | 8/2015 | Yang | G06F 1/185 |
| 9,276,342 | B2 * | 3/2016 | Masubuchi | H01R 12/775 |
| 2005/0277337 | A1 * | 12/2005 | Chen | H01R 12/721 439/637 |
| 2012/0033370 | A1 * | 2/2012 | Reinke | G06F 1/185 361/679.4 |
| 2012/0077389 | A1 * | 3/2012 | Zhang | H01R 24/60 439/660 |
| 2012/0252260 | A1 * | 10/2012 | Tseng | H01R 12/62 439/499 |
| 2013/0109244 | A1 * | 5/2013 | Chen | H01R 12/62 439/682 |
| 2014/0004736 | A1 * | 1/2014 | Chen | H01R 12/77 439/493 |
| 2014/0113484 | A1 * | 4/2014 | Chen | H01R 12/79 439/492 |
| 2015/0064939 | A1 * | 3/2015 | Rabinovitz | H01R 12/721 439/65 |

* cited by examiner

UNITARY INTERFACE USED FOR PCI-E SAS

TECHNICAL FIELD

The present application relates to the field of interface technology, particularly to a unitary interface used for PCI-E SAS.

BACKGROUND OF THE INVENTION

PCI-Express (simply referred to as PCI-E), proposed by INTEL in 2001, is a new criterion for bus and interface and represents an I/O interface standard of the next generation. PCI-E pertains to a high-speed serial point-to-point dual-channel broadband transmission. The devices connected with PCI-E each occupy a dedicated broadband channel rather than sharing the broadband of a bus, and support the functions of active power management, error reporting, stable end-to-end transmission, hot plugging and quality of service (QOS), etc. The new standard PCI-E will completely replace the current PCI and AGP, realizing unification of bus standards. Its main advantage is high-speed data transmission. A speed as high as 10 GB/s could be achieved with the updated version 16×2.0, and there is still great space to improve.

During the process of research and development of PCI-E interface, researchers need to repeatedly plug in and out the connecting portion when testing the interconnecting performance of the interface. However, in order to adapt to the design of long-time fixed connection, the male part of the common PCI-E interface needs to be repeatedly plugged into and out of the female part thereof. This exacerbates the wearing of the interface, causing the risk of unreliable connection.

SUMMARY OF THE INVENTION

The present invention aims at providing a unitary interface used for PCI-E SAS, the unitary configuration of the male part and female part of the interface make it convenient to repeatedly plug in and pull out of the two parts, meanwhile, a high-frequency data transmission speed as high as 12 Gbps could be guaranteed. Furthermore, the interface is a widely applicable to the channels of SATA, SAS and PCI-E.

In order to solve the above mentioned problem, the present application provides the following technical solution. A unitary interface used for PCI-E SAS includes a connecting assembly, a terminal assembly and a fastening assembly. The connecting assembly includes a male sub-assembly, a female sub-assembly and a PCB sub-assembly. The fastening assembly includes at least one ferrule-arm-hook component. The male sub-assembly is provided with more than one male terminal grooves at its connecting end and one male protrusion on each side. The male sub-assembly can be fastened to the PCB sub-assembly so as to conductively connect with the PCB sub-assembly. The female sub-assembly is provided with more than one female terminal grooves on its connecting end and one female protrusion on each side. The female sub-assembly could be fastened to the male sub-assembly by means of the at least one ferrule-arm-hook component. A perforated groove is provided in the PCB sub-assembly, and the connecting end of the female sub-assembly can be accommodated within the perforated groove.

Each ferrule-arm-hook component includes a ferrule, an arm and a hook, with the ferrule and the hook being respectively located at one of the two ends of the arm. The male protrusion and the female protrusion at the same side, which are brought against each other beforehand, can be encircled tightly by each ferrule, while each arm provides elastic force to make each hook respectively snap to one of the two sides of the female sub-assembly.

In a preferred solution, the ferrule-arm-hook component includes at least one protuberance on the inner rim of the ferrule.

In a preferred solution, the male terminal grooves include 40P male terminal grooves, 15P male terminal grooves, 7P male terminal grooves and 6P male terminal grooves, and the female terminal grooves include 40P female terminal grooves, 7P female terminal grooves and 6P female terminal grooves.

The terminal assembly includes 40P terminal sub-assembly, 15P terminal sub-assembly, 7P terminal sub-assembly and 6P terminal sub-assembly 24, wherein each terminal of the 40P terminal sub-assembly, the 7P terminal sub-assembly and the 6P terminal sub-assembly has two connecting pins, a male connecting pin and a female connecting pin. Each of the male connecting pins is inserted into a respective one of the terminal grooves of the male sub-assembly, and each of the female connecting pins is inserted into a respective one of the terminal grooves of the female sub-assembly, and each terminal of the 15P terminal sub-assembly is inserted into a respective one of the terminal grooves of the male sub-assembly.

In a preferred solution, the fastening assembly further includes at least one screw and at least one nut. The male sub-assembly is fastened to the PCB sub-assembly by means of the screw and nut.

In a preferred solution, the male sub-assembly is provided with one outer screw hole on each side and the PCB sub-assembly is provided with one inner screw hole on the corresponding side. Each screw can pass through a respective outer screw hole and a respective inner screw hole and be threadedly engaged to a respective nut.

With the above mentioned technical solutions, the present invention could achieve the following advantageous effects. Firstly, compared with the technical solutions in the prior art, thanks to the unitary configuration of the male part and female part of the present interface, repeated plugging in and pulling out of the two parts is facilitated, meanwhile, a high-frequency data transmission speed as high as 12 Gbps could be guaranteed. Secondly, the interface could be widely applied to the channels of SATA, SAS and PCI-E. Finally, the protuberance in the preferred solutions can further strengthen the ferrule's encirclement and fixation of the male protrusion and the female protrusion.

DETAILED DESCRIPTION OF THE EMBODIMENTS

The present invention will now be described in detail with reference to the specific embodiments, taken in conjunction with FIG. 1 to FIG. 6. However, the description and figures are not intended to limit the scope of the present application.

Figure 1:
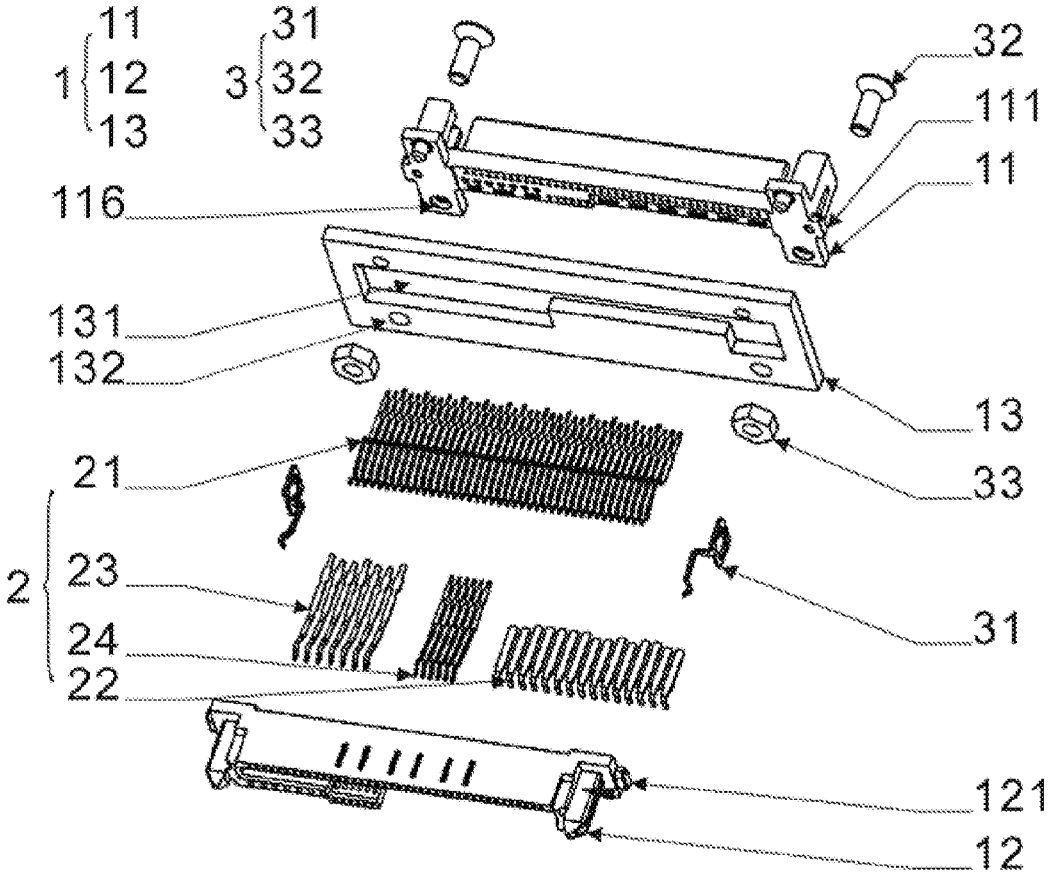
FIG. 1 is an exploded view of the unitary interface used for PCI-E SAS.

As shown in FIG. 1, a unitary interface used for PCI-E SAS specifically comprises a connecting assembly 1, a terminal assembly 2 and a fastening assembly 3. The connecting assembly 1 includes a male sub-assembly 11, a female sub-assembly 12 and a PCB sub-assembly 13. The fastening assembly 3 includes two ferrule-arm-hook components 31. The male sub-assembly 11 is provided at its connecting end with male terminal grooves and provided with one male protrusion 111 on each side. The male sub-assembly 11 can be fastened to the PCB sub-assembly 13 so as to conductively connect with the PCB sub-assembly 13. The female sub-assembly 12 is provided at its connecting end with female terminal grooves and provided with one female protrusion 121 on each side. The female sub-assembly 12 could be fastened to the male sub-assembly 11 by means of the ferrule-arm-hook components 31. There is provided with a groove 131 in the middle of the PCB sub-assembly 13 within which the connecting end of the female sub-assembly 12 can be accommodated.

Figure 3:
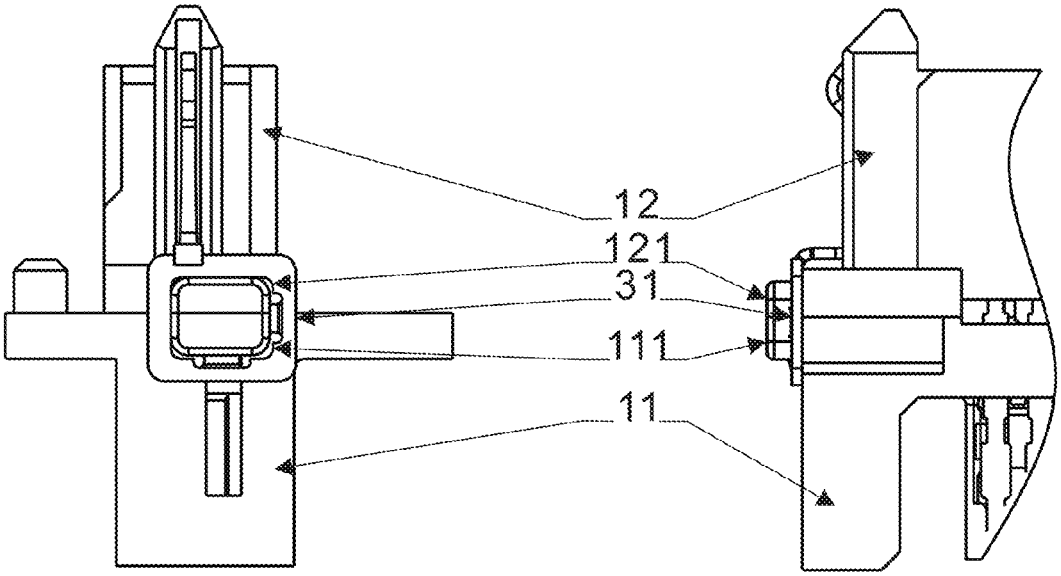
FIG. 3 is a view showing the fixation of the ferrule-arm-hook component.
Figure 4:
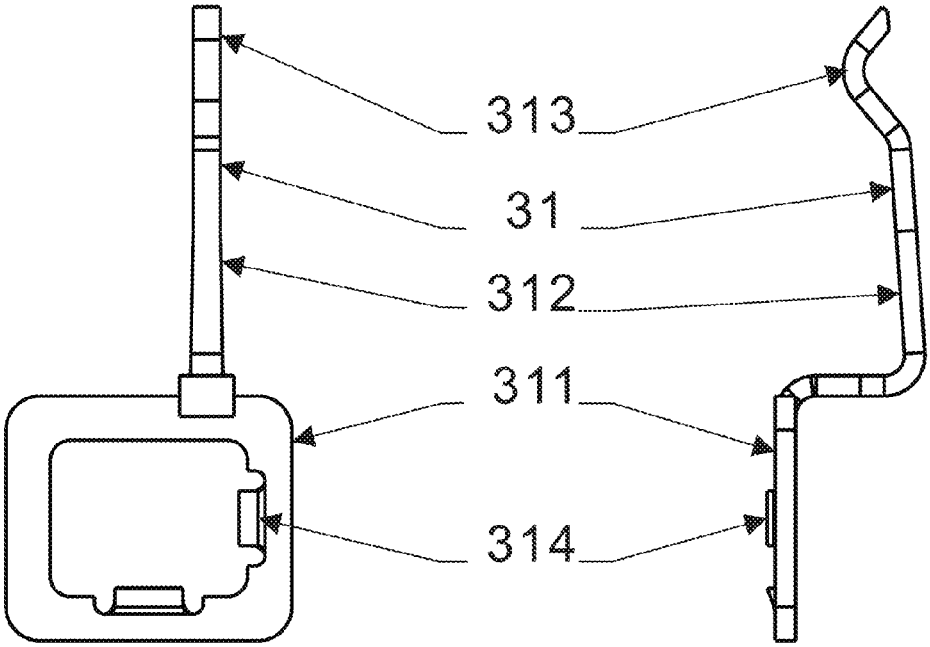
FIG. 4 is a view showing the structure of the ferrule-arm-hook component.

As shown in FIGS. 3 and 4, each of the two ferrule-arm-hook components 31 includes a ferrule 311, an arm 312 and a hook 313. Specifically, the ferrule 311 and the hook 313 are respectively located at the two ends of the arm 312. When the male protrusion 111 and the female protrusion 121 at the same side are brought against each other beforehand, the ferrule 311 can encircle them tightly, and the arm 312 provides elastic force to make the hook 313 snap to one of the two sides of the female sub-assembly 12.

As shown in FIG. 4, on the basis of the above described embodiment, the ferrule-arm-hook component 31 includes two protuberances 314 on the inner rim of the ferrule 311.

Figure 2:
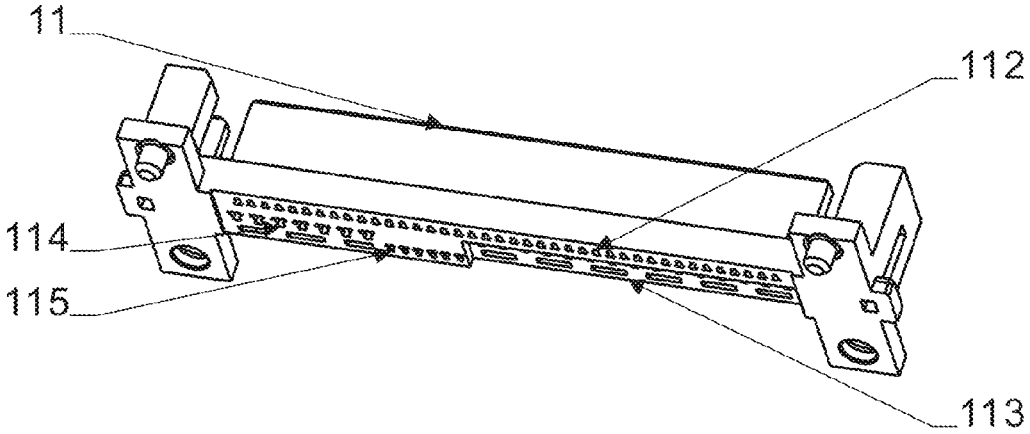
FIG. 2 is a view showing the distribution of the terminal grooves of the male sub-assembly.

As shown in FIG. 2, on the basis of the above described embodiment, the male terminal grooves includes 40P male terminal grooves 112, 15P male terminal grooves 113, 7P male terminal grooves 114 and 6P male terminal grooves 115. The female terminal grooves includes 40P female terminal grooves, 7P female terminal grooves and 6P female terminal grooves.

As shown in FIG. 1, the terminal assembly 2 includes 40P terminal sub-assembly 21, 15P terminal sub-assembly 22, 7P terminal sub-assembly 23 and 6P terminal sub-assembly 24. Among them, each terminal of the 40P terminal sub-assembly 21, the 7P terminal sub-assembly 23 and the 6P terminal sub-assembly 24 has two connecting pins, a male connecting pin and a female connecting pin. Each of the male connecting pins is inserted into a respective one of the terminal grooves of the male sub-assembly 11, and each of the female connecting pins is inserted into a respective one of the terminal grooves of the female sub-assembly 12. Each terminals of the 15P terminal sub-assembly 22 is inserted into a respective one of the terminal grooves of the male sub-assembly 11.

As shown in FIG. 1, on the basis of the above described embodiment, the fastening assembly 3 includes two screws 32 and two nuts 33. The male sub-assembly 11 is fastened to the PCB sub-assembly 13 by means of the screws 32 and nuts 33. The male sub-assembly 11 is provided with one outer screw hole 116 on each side, and the PCB sub-assembly 13 is provided with one inner screw hole 132 on each side. Each screw 32 can pass through a respective outer screw hole 116 and a respective inner screw hole 132 and be threadedly engaged to a respective nut 33.

As shown in FIGS. 1 to 4, the interface according to the present invention facilitates repeated plugging, making it convenient to carry on related performance tests. The particular operating steps are as follows.

(1) Initial Installation

Steps include: fasten the male sub-assembly 11 to the PCB sub-assembly 13; fix the female sub-assembly 12 to the combination of the male sub-assembly 11 and the PCB sub-assembly 13 through the perforated groove 131; at the same time with the above operations, bring the male protrusion 111 and the female protrusion 121 at the same side closely to each other; tightly encircle the male protrusion 111 and the female protrusion 121 at the same side with the ferrule 311 of the respective ferrule-arm-hook component 31; further, pull the two hooks 313 to make them respectively snap to one of the two sides of the female sub-assembly 12. Accordingly, the snapped hooks 313 strengthen through the arm 312 the encirclement and fixing of the ferrules 311 for the male protrusions 111 and the female protrusions 121.

(2) Dismounting

Steps include: pull the hooks 313 upward and away from the sides of the female sub-assembly 12; press the female protrusions 121 against the male protrusions 111, then pull the arms 312 laterally to make the ferrules 311 disconnect from the male protrusion 111 and the female protrusion 121; without the restriction of the ferrules 311, the female sub-assembly 12 is able to be dismounted from the male sub-assembly 11 to complete the whole dismounting process.

(3) Plugging

During the plugging process of the assembled interface, the interface connection is achieved by plugging the cables into the female sub-assembly 12 instead of plugging the male sub-assembly 11 into the female sub-assembly 12.

From the common knowledge in the field, the present invention can be realized by other embodiments which do not depart from the spirit and essential features of the application. Therefore, under any circumstances, the above disclosed embodiments are intended for the purpose of illustration only, and are not intended to be exhaustive. The modifications and variations within the scope of the application or its equivalents will fall within the protection scope of the invention.

The invention claimed is:

1. A unitary interface used for PCI-E SAS comprising:

a connecting assembly, a terminal assembly and a fastening assembly, wherein the connecting assembly includes a male sub-assembly, a female sub-assembly and a PCB sub-assembly, and the fastening assembly includes at least one ferrule-arm-hook component;

wherein the male sub-assembly is provided with more than one male terminal grooves at its connecting end and one male protrusion on at least one side, and the male sub-assembly can be fastened to the PCB sub-assembly so as to conductively connect with the PCB sub-assembly;

wherein the female sub-assembly is provided with more than one female terminal grooves on its connecting end and one female protrusion on at least one side, and the female sub-assembly could be fastened to the male sub-assembly by means of the at least one ferrule-arm-hook component;

wherein a perforated groove is provided in the PCB sub-assembly within which the connecting end of the female sub-assembly can be accommodated; and wherein each ferrule-arm-hook component includes a ferrule, an arm and a hook, with the ferrule and the hook being respectively located at one of the two ends of the arm, and the male protrusion and the female protrusion at the same side, which are brought against each other beforehand, can be encircled tightly by each ferrule, and each arm provides elastic force make each hook respectively snap to each side of the female sub-assembly.

2. The unitary interface used for PCI-E SAS according to claim 1, wherein each ferrule-arm-hook component includes a protuberance on the inner rim of its ferrule.

3. The unitary interface used for PCI-E SAS according to claim 1, wherein the male terminal grooves include 40P male terminal grooves, 15P male terminal grooves, 7P male terminal grooves and 6P male terminal grooves, and the female terminal grooves include 40P female terminal grooves, 7P female terminal grooves and 6P female terminal grooves; and wherein the terminal assembly includes 40P terminal sub-assembly, 15P terminal sub-assembly, 7P terminal sub-assembly and 6P terminal sub-assembly, wherein each terminal of the 40P terminal sub-assembly, the 7P terminal sub-assembly and the 6P terminal sub-assembly has a male connecting pin and a female connecting pin, each of the male connecting pins is inserted into a respective one of the terminal grooves of the male sub-assembly and each of the female connecting pins is inserted into a respective one of the terminal grooves of the female sub-assembly, and each terminal of the 15P terminal sub-assembly is inserted into a respective one of the terminal grooves of the male sub-assembly.

4. The unitary interface used for PCI-E SAS according to claim 1, wherein the fastening assembly further includes at least one screw and at least one nut, and the male sub-assembly is fastened to the PCB sub-assembly by means of the screw and nut.

5. The unitary interface used for PCI-E SAS according to claim 4, wherein the male sub-assembly is provided with one outer screw hole on at least one side and the PCB sub-assembly is provided with one inner screw hole on the corresponding side, and each screw can pass through a respective outer screw hole and a respective inner screw hole and be threadedly engaged to a respective nut.

* * * * *